US006540012B1

(12) United States Patent
Scholz et al.

(10) Patent No.: US 6,540,012 B1
(45) Date of Patent: Apr. 1, 2003

(54) ELECTROSLAG REMELTING PLANT WITH A MOULD AND A HOOD

(75) Inventors: Harald Scholz, Rodenbach (DE); Arno Niebling, Linsengericht (DE); Ulrich Biebricher, Niddatal (DE)

(73) Assignee: ALD Vacuum Technologies AG, Erlensee (DE)

( * ) Notice: Subject to any disclaimer, the term of this patent is extended or adjusted under 35 U.S.C. 154(b) by 0 days.

(21) Appl. No.: 09/566,485

(22) Filed: May 8, 2000

(30) Foreign Application Priority Data

May 7, 1999 (DE) ..... 199 21 161

(51) Int. Cl.[7] ..... B22D 23/10
(52) U.S. Cl. ..... 164/515; 164/508; 164/290
(58) Field of Search ..... 164/515, 470, 164/497, 76.1, 290, 508

(56) References Cited

U.S. PATENT DOCUMENTS

| | | | | |
|---|---|---|---|---|
| 4,738,713 A | * | 4/1988 | Stickle et al. | 75/10.18 |
| 4,951,298 A | * | 8/1990 | Muller | 373/67 |
| 4,993,690 A | * | 2/1991 | Stenzel et al. | 266/158 |
| 5,950,706 A | * | 9/1999 | Choudhury et al. | 164/290 |

FOREIGN PATENT DOCUMENTS

| | | |
|---|---|---|
| AT | 343300 | 2/1975 |
| DE | 2425032 | 11/1975 |
| DE | 3901297 | 7/1990 |
| WO | WO 90/15163 | 12/1990 |

OTHER PUBLICATIONS

Stein, Gerlad, Menzel, Joachim: Unter Druck aufgenstickte Stähle für höchstbeanspruchte Bauteile. in: Stahl u. Eisen 112 (1992), Nr. 4, S. 47–52.

* cited by examiner

*Primary Examiner*—Tom Dunn
*Assistant Examiner*—I.-H. Lin
(74) *Attorney, Agent, or Firm*—Smith, Gambrell & Russell, LLP

(57) ABSTRACT

In an electroslag remelting point with a mold (4) for forming an ingot from the remelted material of at least one consumable electrode (33), with a body (6) having at least one vertically driven electrode rod (15) for advancing a respective consumable electrode (33), and with a hood (19) which is disposed above the mold (4) and has at least one opening (18) which is concentric with the respective electrode axis (A), a pot-shaped boiler (20) is provided which accommodates the mould (4) and can be joined to the hood (19) to form a chamber (34) which is closed all round, completely encompasses the mould (4, 28) and can be connected via pipelines (22, 23) to a vacuum pump and/or a gas source, so that the chamber (34) can be evacuated or filled with an inert gas.

16 Claims, 1 Drawing Sheet

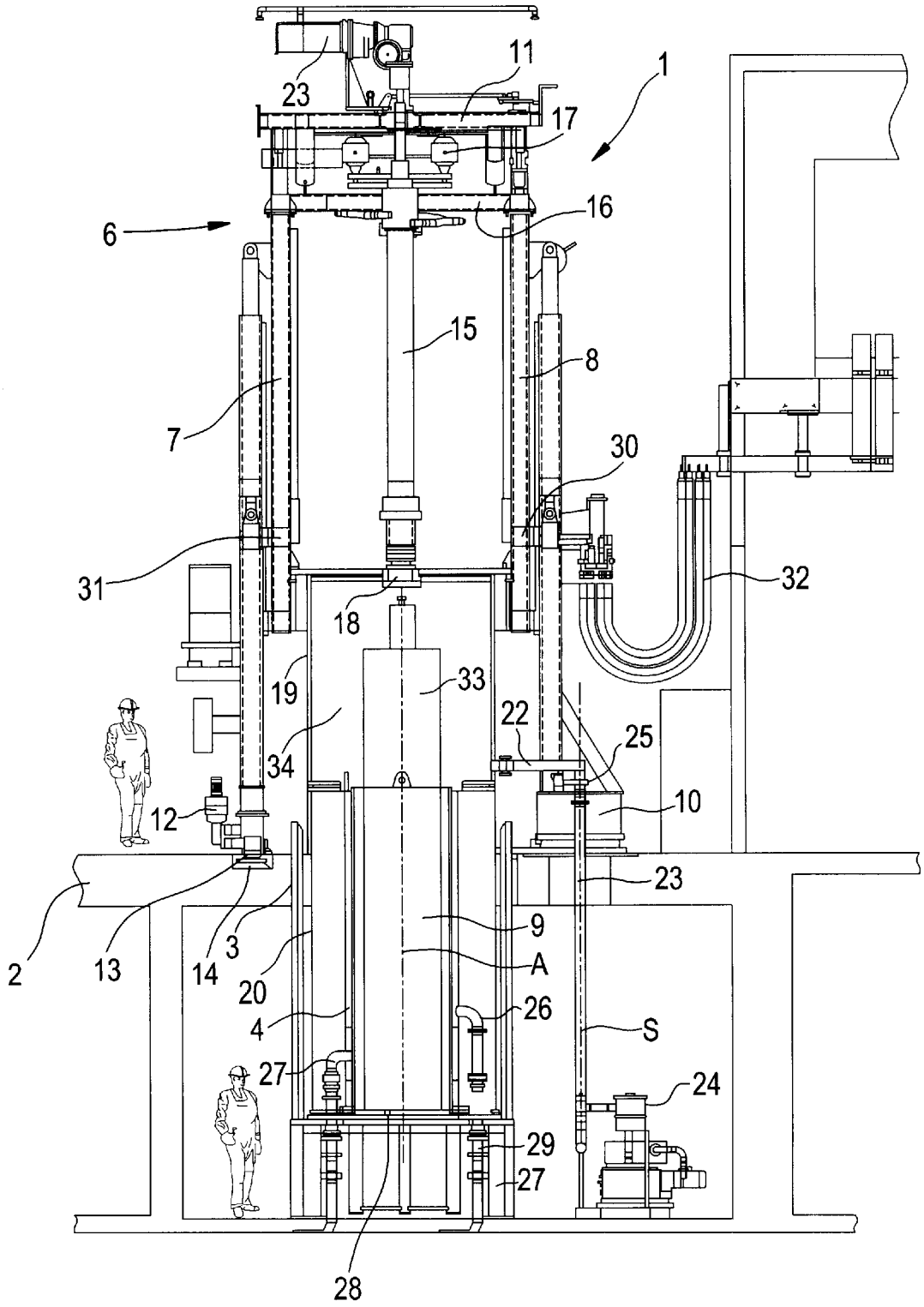
1
11
23
17
16
6
15
8
7
30
31
32
18
19
33
22
25
34
10
12
23
2
13
14
3
9
20
A
4
26
S
27
24
29
27
28

ELECTROSLAG REMELTING PLANT WITH A MOULD AND A HOOD

BACKGROUND OF THE INVENTION

The invention relates to an electroslag remelting plant with a mould for forming an ingot from the remelted material of at least one consumable electrode, with a body having at least one vertically driven electrode rod for advancing a respective consumable electrode and with a hood which is disposed above the mould and has at least one opening which is concentric with the respective electrode axis.

A remelting plant of this kind is known from DE-AS 20 31 708. The hood of this plan serves to reduce the radiation losses and for this purpose is lined with a mineral heat insulation. It is the actual electrode which is passed through the hood rather than the electrode rod in the known solution. As consumable electrodes of this kind generally have an irregularly chaped surface due to the process according to which they are manufactured, the opening in the hood must be of correspondingly large dimensions.

The molten clag, which is at a high temperature, to some extent represents the heating resistance for the melting current in the remelting process. In this case the metal of the consumable electrode, which dips into the molten slag, is conveyed in drop form through the slag and collects below the latter in a molten pool, which solidifies at its lower phase boundary to form an ingot. The heat dissipation required for the solidification process takes place through the mould unit, through which a coolant (water) generally flows. An essential element for the metallurgical cleaning process in this case is the slag, the composition of which may vary according to the impurities which are to be removed and metals which are used. A large number of slag compositions are known.

Also known is an electroslag remelting plant with a mould for forming an ingot from the remelted material of at least one consumable electrode (DE 39 01 297), with a body having at least one vertically driven electrode rod for advancing a respective consumable electrode and with a hood which is disposed above the mould and has at least one opening which is concentric with the respective electrode axis, wherein the hood is divided into sectors which can move laterally in relation to its vertical axis, each of which is joined by its lower edge to the upper part of the mould in a largely gastight manner at a first sealing point and sealed off by its upper edge from the electrode rod, likewise in a largely gastight manner, at a second sealing point, and has an interior space of a cross section and a height which are such that the upper end of the consumable electrode, of which there is at least one, is located below the second sealing point of the hood when raised to its highest position.

The side walls of slab moulds are composed of a plurality of individual side walls, usually four, which are braced. This technique is advisable if frequent reworking of the mould is to be avoided. A disadvantage here lies in the fact that this type of mould cannot at present be used in a closed type of plant, as described in the above mentioned patent specification. When employing the known technique it is impossible to prevent air or other gases from the environment from entering the melting space during remelting and thus affecting the result of this remelting.

SUMMARY OF THE INVENTION

The object of the invention is to remelt a slab mould (square or rectangular) consisting of a plurality of side parts in a closed space without air from outside of the plant having access to the melting space.

This object is achieved according to the invention by a pot-shaped boiler which accommodates the mould and can be joined to the hood to form a chamber which is closed all round, completely encompasses the mould and can be connected via pipelines to a vacuum pump and/or a gas source, wherein a separate coolant connection for the mould shell and for the mould bottom is provided in each case.

A wide range of embodiments are possible within the scope of the invention; one of these is represented in a purely diagrammatic form in the accompanying drawing, which shows a vertical section through an electroslag remelting plant.

BRIEF DESCRIPTION OF THE DRAWINGS

An electoslag remelting plant 1, which is set up on a shop floor 2, is represented in the drawing. A mould 4 projects through an opening 3 in the shop floor into a pit, only the bottom 5 of which is shown. The mould 4 is a conventional, water-cooled upright mould. A furnace body 6 with a plurality of vertical columns 7 and 8—only two of which are visible—is located above the shop floor 2. The column 8 is of a shortened length and rests on the shop floor 2, with a pivot bearing 10 being disposed in between.

DETAILED DESCRIPTION OF THE PREFERRED EMBODIMENTS

The pivot bearing 10 defines a vertical rotational axis for the furnace body 6, whose columns 7 which are remote from the rotational axis and parallel to the body comprise at the lower end a travelling drive 12, to which a respective roller 13 belongs, the latter rolling on a circular arc-shaped rail 14 located in the shop floor 2.

The furnace body is provided with an upper platform 11, so that the furnace body looks like an "A" in side view. The upper platform 11 is formed as a frame, on which a measuring device 16 is held, the latter co-operating with a plurality of load cells 17. An electrode rod 15 is led into the interior of the hood 19 in a gastight manner by means of a slide seal 18.

This hood 19 rests by way of its lower circumferential edge on the pot-shaped boiler 20, which is supported via a stand 21 on the pit bottom 5. The hood is joined via pipelines 22, 23 to a vacuum pump 24, both pipelines 22, 23 being joined together in the region of the pivot axis 9 via a coupling 25. The shell of the mould 4 is connected to coolant feed and coolant return pipes, while the mould bottom 28 communicates with a separate cooling circuit via a pipe 29. The columns 7, 8 are provided with lifting apparatus 30, 31, on which the hood 19 is held, so that the hood 19 can be moved upwards and separated from the boiler 20. The cables 32 for supplying current to the melting device are also coupled to the lifting device 30.

The described electroslag remelting point enables the electrode material to be remelted in the chamber 34, which can be completely closed, and the mould 4, 28 may be formed both as a one-part and as a multiple-part mould. It is therefore possible to remelt electrodes 33 to form slabs in an inert or artificial atmosphere or under vacuum or at a pressure above atmospheric. The described remelting plant in particular enables remelting to be carried out under vacuum without slag both in round and rectangular configurations by means of direct current.

What is claimed is:

1. Electroslag remelting plant comprising:

a mould for receiving at least one consumable electrode and for forming an ingot from the consumable electrode, a body for advancing the consumable electrode, a hood which is disposed above the mould having at least one opening which is concentric with an axis of the consumable electrode, a pot-shaped boiler accommodates the mould, said pot-shaped boiler is joined to the hood to form a closed chamber that completely encompasses the mould.

2. The electroslag remelting plant according to claim 1, wherein said hood is connected to a vacuum pump.

3. The electroslag remelting plant according to claim 1, wherein said hood is connected to a gas source.

4. The electroslag remelting plant according to claim 1, wherein the mould has a coolant connection.

5. The electroslag remelting plant according to claim 1, further comprising:

a mould shell, and a mould bottom, wherein said mould shell and mould bottom have separate coolant connections.

6. The electroslag remelting plant according to claim 1, wherein the mould is a multi-part mould.

7. The electroslag remelting plant according to claim 1, wherein the mould is a one-part mould.

8. Electroslag remelting plant comprising:

a hood, a pot-shaped boiler attached to the hood, and a mould located inside the pot-shaped boiler, wherein the pot-shaped boiler and the hood form an airtight chamber that completely encompasses the mould.

9. The electroslag remelting plant according to claim 8, further comprising:

a slide seal located on the hood.

10. The electroslag remelting plant according to claim 9, further comprising:

an electrode rod which enters the airtight chamber through the slide seal.

11. The electroslag remelting plant according to claim 8, further comprising:

a vacuum pump attached to the hood.

12. The electroslag remelting plant according to claim 8, further comprising:

a gas source attached to the hood.

13. The electroslag remelting plant according to claim 8, further comprising:

a coolant feed attached to the mould, and a coolant return attached to the mould.

14. The electroslag remelting plant according to claim 8, further comprising:

a mould shell, and a mould bottom, wherein the mould shell and the mould bottom are attached to a separate cooling circuit.

15. The electroslag remelting plant according to claim 8, wherein the mould is a multi-part mould.

16. The electroslag remelting plant according to claim 8, wherein the mould is a one-part mould.

* * * * *